US010480261B2

(12) United States Patent
Thomas et al.

(10) Patent No.: US 10,480,261 B2
(45) Date of Patent: Nov. 19, 2019

(54) ENHANCED RADIAL SUPPORT FOR WIRELINE AND SLICKLINE

(71) Applicant: Halliburton Energy Services, Inc., Houston, TX (US)

(72) Inventors: Sean Gregory Thomas, Frisco, TX (US); Jack Gammill Clemens, Fairview, TX (US); Wei Zhang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 333 days.

(21) Appl. No.: 15/325,942

(22) PCT Filed: Aug. 15, 2014

(86) PCT No.: PCT/US2014/051280
§ 371 (c)(1),
(2) Date: Jan. 12, 2017

(87) PCT Pub. No.: WO2016/024995
PCT Pub. Date: Feb. 18, 2016

(65) Prior Publication Data

US 2017/0133124 A1 May 11, 2017

(51) Int. Cl.
*E21B 17/20* (2006.01)
*H01B 7/18* (2006.01)
(Continued)

(52) U.S. Cl.
CPC ..... *E21B 17/20* (2013.01); *E21B 17/00* (2013.01); *E21B 17/003* (2013.01); *E21B 19/00* (2013.01); *H01B 7/046* (2013.01); *H01B 7/182* (2013.01)

(58) Field of Classification Search
CPC ..... E21B 17/00; E21B 17/003; E21B 17/20
See application file for complete search history.

(56) References Cited

U.S. PATENT DOCUMENTS 3,449,199 A 6/1969 Mead
4,082,423 A 4/1978 Glista et al.
(Continued)

FOREIGN PATENT DOCUMENTS

DE 3342274 A1 5/1985

OTHER PUBLICATIONS

International Preliminary Report on Patentability issued in related Application No. PCT/US2014/051280, dated Mar. 2, 2017 (11 pages).
(Continued)

*Primary Examiner* — Kristyn A Hall
*Assistant Examiner* — Tara E Schimpf
(74) *Attorney, Agent, or Firm* — Alan Bryson; Baker Botts L.L.P.

(57) ABSTRACT

In accordance with embodiments of the present disclosure, a cable system for conveying well servicing equipment into a wellbore includes a core support structure extending longitudinally along an axis of the cable system. The core support structure comprises polymer reinforced with fibers, and the fibers are oriented substantially parallel to the axis of the cable system. The cable system also includes a mesh layer disposed around and bonded to the core support structure. The mesh layer includes metal wrapped around the core support structure. The cable system also includes a polymeric coating disposed around and bonded to the mesh layer. The mesh layer enables increased structural support of the cable system, particularly against forces in the radial direction relative to the axis of the cable system. In some applications, the mesh layer acts as a return conductive path for conductors embedded in the core support structure.

19 Claims, 4 Drawing Sheets

(51) Int. Cl.

| | |
|---|---|
| ***E21B 17/00*** | (2006.01) |
| ***H01B 7/04*** | (2006.01) |
| ***E21B 19/00*** | (2006.01) |

(56) References Cited

U.S. PATENT DOCUMENTS

| | | | | |
|---|---|---|---|---|
| 4,156,104 | A | 5/1979 | Mondello | |
| 5,103,067 | A * | 4/1992 | Aldissi | H01B 11/1033 174/107 |
| 5,220,134 | A | 6/1993 | Novel et al. | |
| 5,234,058 | A | 8/1993 | Sas-Jaworsky et al. | |
| 5,495,546 | A | 2/1996 | Bottoms, Jr. et al. | |
| 6,004,639 | A | 12/1999 | Quigley et al. | |
| 6,296,066 | B1 | 10/2001 | Terry et al. | |
| 6,463,198 | B1 | 10/2002 | Coleman et al. | |
| 6,760,523 | B2 | 7/2004 | Nechitailo | |
| 6,992,253 | B1 | 1/2006 | Spellman et al. | |
| 7,935,415 | B1 | 5/2011 | Hansen et al. | |
| 2004/0045379 | A1 | 3/2004 | Silverman et al. | |
| 2004/0216871 | A1 * | 11/2004 | Mendez | E21B 33/1277 166/187 |
| 2006/0242824 | A1 | 11/2006 | Varkey et al. | |
| 2011/0075978 | A1 * | 3/2011 | Rose | H01B 3/302 385/102 |
| 2011/0174519 | A1 | 7/2011 | Shah et al. | |
| 2011/0300008 | A1 * | 12/2011 | Fielder | E21B 19/002 417/410.3 |
| 2013/0294735 | A1 | 11/2013 | Burris et al. | |
| 2014/0102806 | A1 * | 4/2014 | Millet | E21B 17/003 175/315 |

OTHER PUBLICATIONS

International Search Report and Written Opinion issued in related PCT Application No. PCT/US2014/051280 dated May 14, 2015, 14 pages.

Holesinger, Terry G., et al. "Carbon Nanotube Composite Cables for Ultra-Deepwater Oil and Gas Fields." Offshore Technology Conference. Offshore Technology Conference, 2014.

Knapp, R. H., and Terry S. Shimabukuro. "Structural analysis of composite umbilical cables." The Seventeenth International Offshore and Polar Engineering Conference. International Society of Offshore and Polar Engineers, 2007.

Pakrastinsh, L., K. Rocens, and D. Serdjuks. "Evaluation of the Behavior of Tensioned Composite Cladding Element for Cable Roofs." Sci. Proc. of Riga Technical University 2 (2005): 185-193.

* cited by examiner

ENHANCED RADIAL SUPPORT FOR WIRELINE AND SLICKLINE

CROSS-REFERENCE TO RELATED APPLICATION

The present application is a U.S. National Stage Application of International Application No. PCT/US2014/051280 filed Aug. 15, 2014, which is incorporated herein by reference in its entirety for all purposes.

TECHNICAL FIELD

The present disclosure relates generally to well drilling and hydrocarbon recovery operations and, more particularly, to systems and methods that provide enhanced radial support for a cable that may be used in well drilling and/or hydrocarbon recovery operations.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

After drilling a wellbore that intersects a subterranean hydrocarbon-bearing formation, a variety of wellbore tools may be positioned in the wellbore during completion, production, and/or remedial activities. For example, temporary packers may be set in the wellbore during the completion and production operating phases of the wellbore. In addition, various operating tools including flow controllers (e.g., chokes, valves, etc.) and safety devices such as safety valves may be deployed in the wellbore. Such tools are often lowered downhole by a wireline, a work string, or a slickline and may be configured with a fishing neck to facilitate recovery at a later time. Once downhole, the tool may be set at a desired location and released, allowing the wireline, work string, or slickline to be retrieved.

As noted above, wirelines, slicklines, and/or cables can be used to lower and retrieve wellbore tools from the wellbore. A wireline generally includes an electrically conductive cable surrounded by steel wires or unidirectional carbon fibers and encased within a polymeric coating. The term "slickline" may indicate a similar cable without the electrical conductor running through the middle. It is now recognized that wirelines and slicklines of relatively long lengths are susceptible to undesirable crack propagation, excessive mechanical wear, and pullout at points where the line couples to a wellbore tool.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the invention.

Certain embodiments according to the present disclosure may be directed to wirelines, slicklines, and other downhole cable placement systems used in well drilling and hydrocarbon recovery operations, these cable systems having an enhanced radial support structure. More specifically, present embodiments are directed to downhole cable placement systems that include composite carbon fiber reinforced polymer with fibers oriented in an axial direction of the cable system, a mesh layer disposed around and bonded to the carbon fiber reinforced polymer, and an outer polymeric coating disposed around and bonded to the mesh layer. The carbon fiber reinforced core support member provides increased tensile strength to the cable system in the axial direction. The mesh layer around the outside of this core support member may include a mesh of metal or strong fiber members that enhance the strength of the cable system in the radial direction, providing resistance to compression, bending stresses, and/or pull out that may occur in other cable systems. In some embodiments, the core support member may surround a central fiber optic cable bundle or one or more electrical conductors of the cable system. Some embodiments may include a single electrical conductor in the center, while the mesh layer provides a return electrical path for the single conductor. This enables a relatively smaller diameter and lower weight wireline than would be available using conventional fiber reinforced wirelines.

Figure 1:
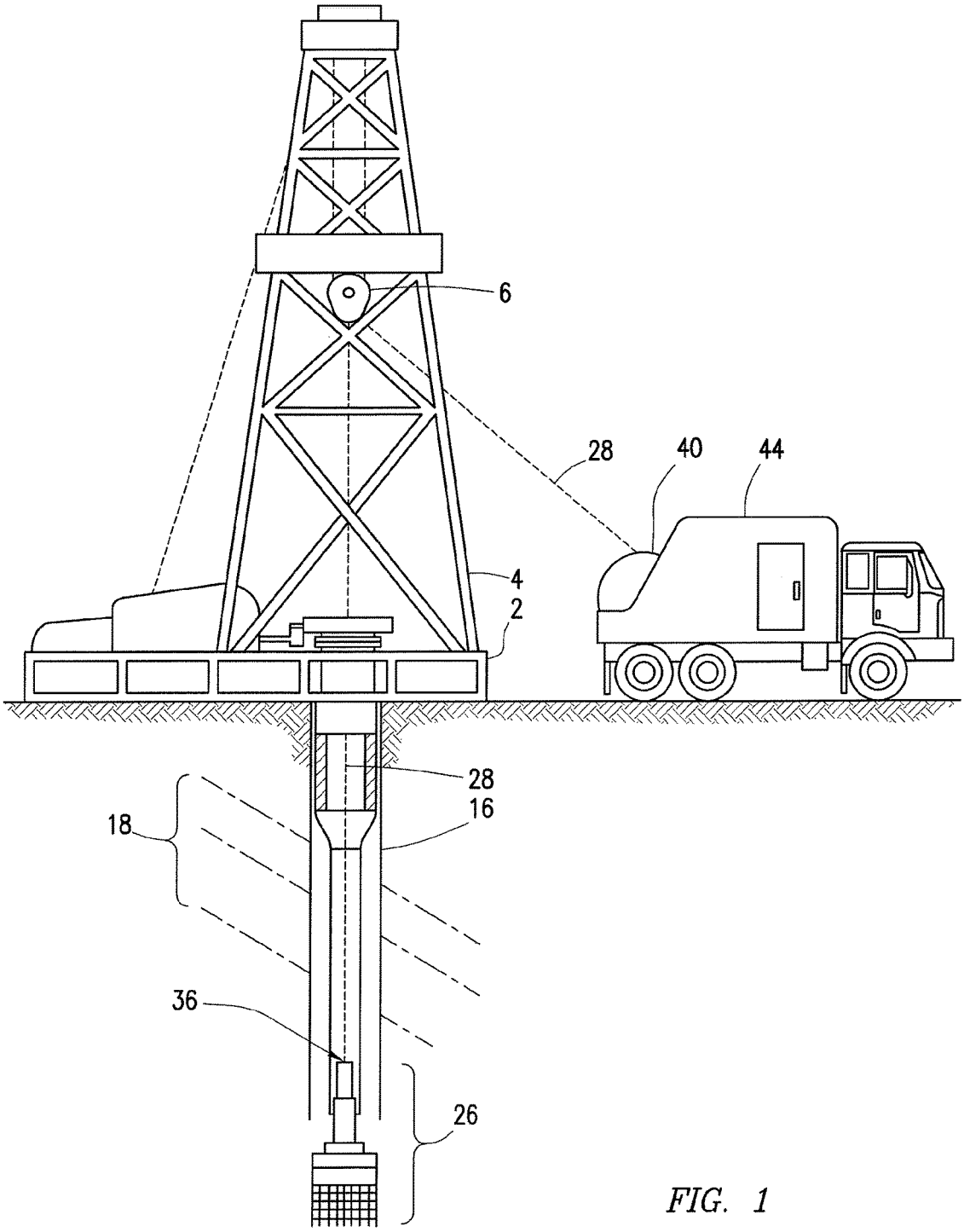
FIG. 1 is a schematic partial cross-sectional view of a wireline/slickline being deployed in a wellbore drilling environment, in accordance with an embodiment of the present disclosure.

Turning now to the drawings, FIG. 1 illustrates oil well equipment being used in an illustrative drilling environment. A drilling platform 2 supports a derrick 4 having a traveling block 6 for raising and lowering a drill string (not shown). The drill string creates a wellbore 16 that passes through various formations 18. At various times during the drilling process, the drill string may be removed from the wellbore 16. Once the drill string has been removed, a subsurface device 26 (e.g., a plug, packer, etc.) may be lowered downhole to the desired setting depth via a conveying member 28.

The subsurface device 26 may be used, for example, to seal off or isolate zones inside the wellbore 16. During deployment, the subsurface device 26 may be coupled to the conveying member 28 at a rope socket 36. When the subsurface device 26 reaches the desired location within the wellbore 16, the subsurface device 26 is set in place within the wellbore 16. After the subsurface device 26 is securely set in place, the conveying member 28 may be released and retracted. Although the illustrated drilling platform 2 shows an on-shore drilling rig, various embodiments of the present disclosure may be used off-shore or in other drilling platforms or locations without restriction.

In present embodiments, the conveying member 28 is a cable system for conveying well servicing equipment (e.g., subsurface device 26) into the wellbore 16. In some embodiments, the conveying member 28 may include a wireline or a slickline. A wireline generally includes a conductive cable surrounded by a core support member and encased within a polymeric coating. A slickline may include a core support member encased within a polymeric coating without an electrical conductor running through the middle. Some slicklines may include a core structural member through the middle, while others may include a fiber optic bundle for communication along the slickline. In some embodiments, the fiber optic bundle may facilitate communication between a component at the surface and the subsurface device 26, or between two different subsurface devices that are communicatively coupled to the slickline.

The conveying member 28 may be unspooled from a spool 40 on a slickline truck 44 onto a sheave (e.g., traveling block 6 or some other sheave) on the drilling platform 2. From here, the conveying member 28 may be lowered (deployed) into the wellbore 16 and subsequently raised (retracted) from the wellbore 16 after placing the subsurface device 26 as described above. In presently disclosed embodiments, this conveying member 28 may include a core support structure of polymer reinforced with axially aligned carbon fibers and a mesh layer disposed around the core structural layer to provide radial support to the conveying member 28. The conveying member 28 also includes an outer polymeric coating disposed around and bonded to the mesh layer. Embodiments of the conveying member 28 are described in further detail below in reference to FIGS. 2-5. Persons having ordinary skill in the art will see that the conveying member 28 may be used for a wide variety of activity including deployment of various tools, sensors, equipment, etc. downhole and should not be limited to the examples explicitly described above.

Figure 2:
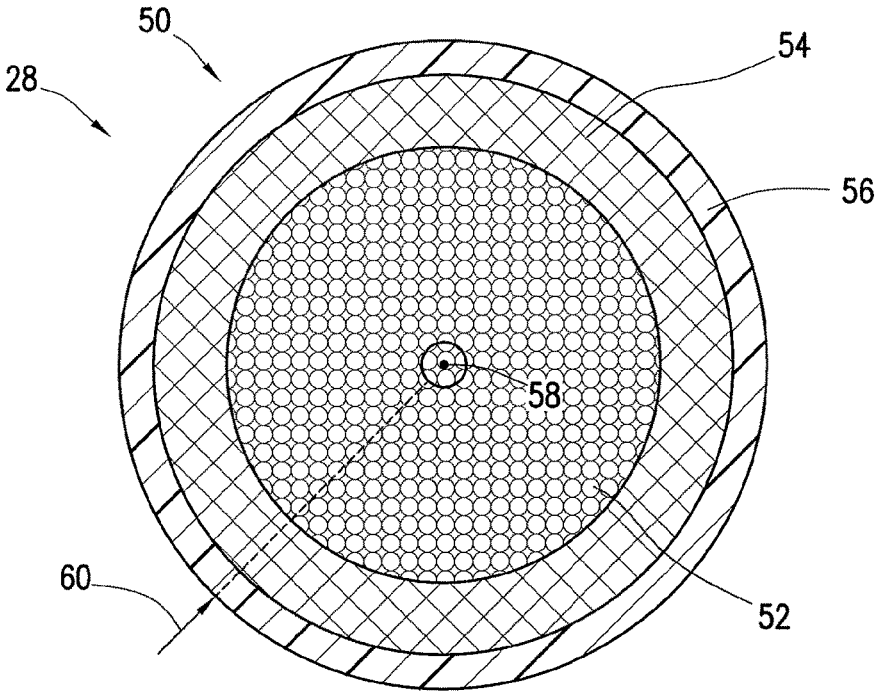
FIG. 2 is a schematic cutaway view of a slickline having a mesh layer for radial support, in accordance with an embodiment of the present disclosure.

FIG. 2 is a cutaway view of an embodiment of the conveying member 28 used to convey well servicing equipment into the wellbore 16 of FIG. 1. The illustrated conveying member 28 is a slickline 50 that does not include any central conductors. Instead, the slickline 50 includes a central core support structure 52. The central core support structure 52 provides mechanical support for the conveying member 28 against the weight of the slickline 50 itself as well as any well servicing equipment being lowered or hoisted via the slickline 50. In the illustrated embodiment, the slickline 50 includes a mesh layer 54 disposed around the core support structure 52. The mesh layer 54 may be bonded to the core support structure 52. The mesh layer 54, as described in detail below, may provide resistance to crack propagation, delamination, and other undesirable effects on the core support structure 52. In addition, the slickline 50 includes a polymeric coating 56 disposed around the mesh layer 54. The polymeric coating 56 may be bonded to the mesh layer 54. The polymeric coating 56 may provide an outer layer of protection for the slickline 50 and/or a barrier between the wellbore environment and the interior layers of the slickline 50.

The core support structure 52 extends longitudinally along an axis 58 of the slickline 50, and the core support structure is designed to withstand tensile stress and strain applied to the slickline 50 along this axis 58. In some embodiments, the core support structure 52 is a composite structure constructed from fiber reinforced polymer. For example, the core support structure 52 may be formed from a thermoplastic polymer matrix such as polyphenylene sulfide (PPS) filled with carbon fibers. It should be noted that other types of materials and compositions may form this reinforced core support structure 52 in other embodiments of the slickline 50.

In order to provide the desired tensile support for the slickline 50, the fibers within the core support structure are oriented substantially parallel (e.g., within approximately 10 degrees) to the longitudinal axis 58 of the slickline 50. In this orientation the composite core support structure 52 may support the slickline 50 in tension. This tension may occur, for example, when the weight of the slickline 50 and any components coupled thereto pull down on the slickline 50 while it is being deployed into, or retracted from, the wellbore 16 (as shown in FIG. 1). By aligning the fibers of the core support structure 52 substantially parallel to the axis 58, the slickline 50 may be able to support heavier loads, transport loads through deeper wells, and/or utilize less material than would be available with other less uniform fiber orientations.

Although the described core support structure 52 can dissipate many of the tension forces applied to the slickline 50, the uniaxial orientation of the fibers in the core support structure 52 may leave the core support structure susceptible to compression forces and forces in the radial direction relative to the axis 58. Presently disclosed embodiments of the slickline 50 provide the mesh layer 54 to provide support against these compressive and radial forces. The mesh layer 54 may contain material wrapped around and bonded to the core support structure 52. The mesh layer 54 may be bonded and molded with the outer polymeric coating 56 as well. The mesh layer 54 may have an outer diameter that is less than or equal to an inner diameter of the polymeric coating 56.

The mesh layer 54 may be constructed as a metallic mesh. The metallic mesh may be made from entirely metallic elements or from metallic alloys (e.g., steel or MP35N). The metallic mesh may be made from any alloy that is resistant to corrosion and to hydrogen sulfide (H2S). Such metallic mesh may have a relatively high strength, corrosion resistance, ductility, and a relatively high modulus of elasticity. Other types of materials may be used for the mesh layer 54 in other embodiments, such as carbon reinforced polymer having the carbon fibers oriented in a direction wrapping around the core support structure 52, or an aramid (e.g., Kevlar).

In some embodiments, the polymeric coating 56 may be formed from a thermoplastic polymer, such as polyether ether ketone (PEEK). However, other types of polymers or polymer-based materials may be used to form the polymeric coating 56 in other embodiments. Further, additives or additional coatings may be used in conjunction with the polymeric coating 56 to provide desirable protection of the mesh layer 54 and core support structure 52.

The mesh layer 54 may include wires, fibers, or other members of mesh that are oriented in a specific manner to strengthen the slickline 50 against radial and compressive forces. For example, in some embodiments, at least one of the mesh members may be oriented orthogonally to the axis 58. That is, the mesh member may be at least partially wrapped around the core support structure 52 in a plane that is orthogonal to the axis 58 of the slickline 50. This orientation of the mesh member may provide a maximum amount of support and strength to the core support structure 52 in a radial direction (e.g., as shown by arrow 60). This orientation of the mesh member may also provide the mesh layer 54 and/or the core support structure 52 with greater resistance to crack propagation in the direction of the axis 58.

The mesh layer 54, in combination with the axially aligned fiber reinforced core support structure 52, may increase the lifetime of the slickline 50. The mesh layer 54, as noted above, may provide resistance to crack propagation through the core support structure 52, thereby making the slickline 50 more resistant to excessive delamination of the core support structure 52 when exposed to radially compressive loads. The mesh layer 54 may also provide support if layers of the core support structure 52 attempt to separate and expand outward when the slickline 50 is under compression. Additionally, if the polymeric coating 56 becomes worn due to wear from unspooling or contacting the downhole formation, the mesh layer 54 may provide an additional protective layer for abrasion resistance to maintain the slickline 50 until drilling operation is completed.

As noted above, the subsurface device 26 (of FIG. 1) may be coupled to the conveying member 28 (e.g., slickline 50) during deployment and/or retraction of the conveying member 28. The mesh layer 54 in the slickline 50 may increase the ability of the subsurface equipment to grip the slickline 50. This is because the mesh layer 54 may include metallic or fibrous pieces of mesh that are not oriented in the direction of the axis 58 and, therefore, may provide an increased coefficient of friction in the direction of the axis 58. As a result, the subsurface equipment coupled to the slickline 50 may be less likely to slip along the slickline 50 in the axial direction in response to gravitational forces.

The mesh layer 54 also may protect the core support structure 52 from potential fiber breakage or pullout at gripping points, such as the rope socket 36 illustrated in FIG. 1, where the conveying member 28 meets the subsurface device 26. By providing an increased coefficient of friction at the rope socket, the mesh layer 54 may facilitate a more robust gripping mechanism for the subsurface equipment, making it less likely for the equipment to separate the fibers of the core support structure 52 from one another.

Different manufacturing methods may be used to produce the presently disclosed conveying member 28 with the mesh layer 54. For example, the mesh layer 54 may be formed as mesh that is overbraided onto the core support structure 52. In some embodiments, the mesh layer 54 may include metal or some other material wrapped in ribbons or sheets around the core support structure 52. In some embodiments, the mesh layer 54 may include such ribbons or sheets wrapped helically around the core support structure 52. When the mesh layer 54 is helically wrapped, it may be desirable to form the mesh layer 54 in two continuous strips helically wrapped in opposite directions around the core support structure 52. This may help to maintain desirable coverage and contact of the mesh layer 54 to itself and to the core support structure 52. Prior to application of the mesh layer 54, the composite core support structure 52 may be manufactured. After applying the mesh layer 54, the polymeric coating 56 may be melted around the mesh layer 54 or the mesh layer 54 and core support structure 52 may be run through a die having the polymeric coating 56.

Figure 3:
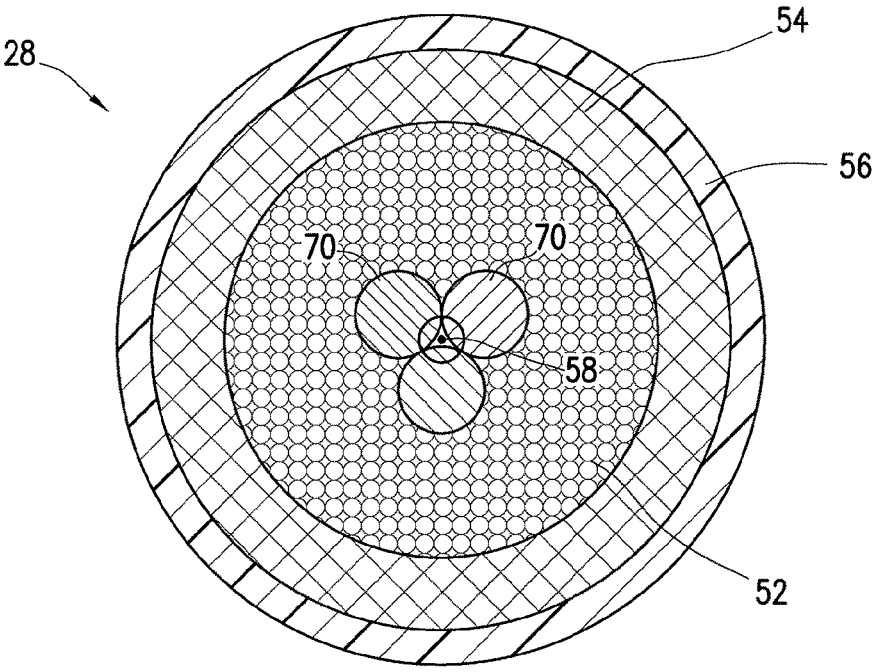
FIG. 3 is a schematic cutaway view of the wireline/slickline of FIG. 1 having a mesh layer for radial support and central fiber optics, conductors, or both, in accordance with an embodiment of the present disclosure.

FIG. 3 is a cutaway view of another embodiment of the conveying member 28 used to convey well servicing equipment into the wellbore 16 of FIG. 1. The illustrated conveying member 28 includes a plurality of conductors 70 embedded or otherwise disposed within the core support structure 52. The conductors 70 extend along, or at least in parallel with, the longitudinal axis 58 of the conveying member 28. The conveying member 28 may include a slickline or a wireline, depending on the type of conductors 70 disposed therein. For example, the conductors 70 may include one or more electrical conductors when the conveying member 28 is a wireline. These electrical conductors may be used to transmit power along the wireline. In some embodiments, the electrical conductors may facilitate communication of power from a device at the surface to the subsurface equipment attached to the wireline, or from one subsurface component to another subsurface component. In some embodiments, the electrical conductors may also provide communication via electrical signals flowing therethrough. In slickline embodiments of the conveying member 28, the conductors 70 may include a bundle of fiber optic cables used to convey fiber optic communication signals through the slickline. In other embodiments, the conductors 70 may include a combination of electrical conductors and fiber optic cables for providing electrical energy and communication, respectively, through the conveying member 28.

As described above with reference to FIG. 2, the conveying member 28 may include a slickline 50 having no conductors disposed through the middle of the core support structure 52. It should be noted that the illustrated embodiment of the conveying member 28 in FIG. 3 includes the same core support structure 52, mesh layer 54, and polymeric coating 56 as described at length above in reference to FIG. 2. Again, the mesh layer 54 provides increased structural support of the conveying member 28 against forces in the radial direction, compressive forces, and pull-out forces at connection points (e.g., rope socket).

Figure 4:
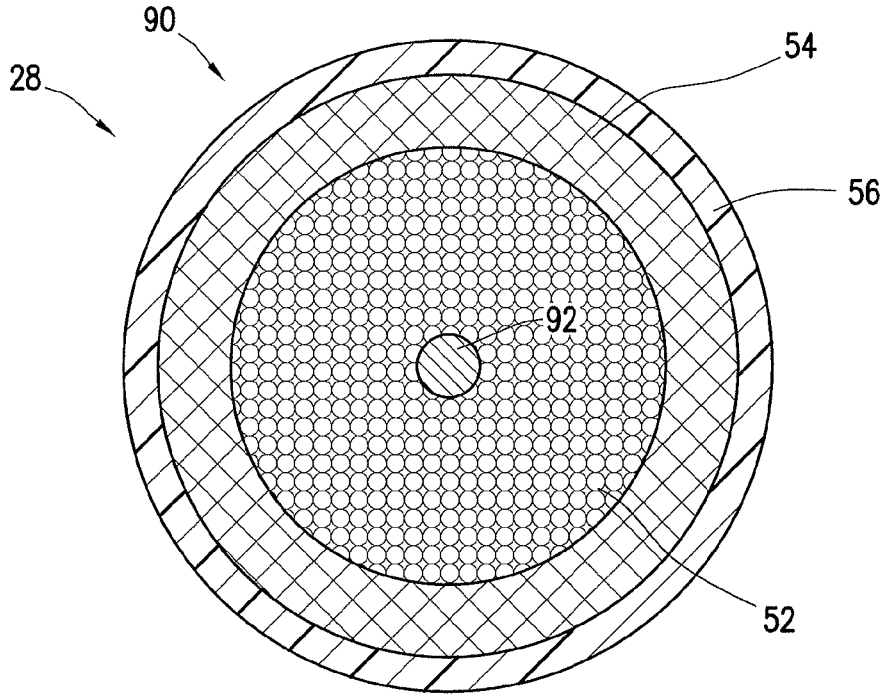
FIG. 4 is a schematic cutaway view of a wireline having a mesh layer for radial support and a single electrical cable, in accordance with an embodiment of the present disclosure.

FIG. 4 illustrates another embodiment of the conveying member 28, this one including a wireline 90 having a single electrical conductor 92 running through the center of the core support structure 52. In the illustrated wireline 90, the mesh layer 54 may be made of an electrically conductive material (e.g., metal). This may enable the wireline 90 to electrically ground the single electrical conductor 92 to the mesh layer 54, in order to transmit electrical energy through the wireline 90. That is, the electrical energy may travel in one direction through the electrical conductor 92, while the wire mesh layer 54 acts as a return conductor path. As a result, the wireline 90 may contain a single electrical conductor 92 (e.g., copper wire or communication wire) and still be able to effectively transmit electrical signals via the wireline 90.

The mesh layer 54 may enable the use of a single electrical conductor 92 in the wireline 90, thereby reducing the weight of the wireline 90, since an additional return electrical conductor would add weight to the wireline 90 without increasing the strength of the core support structure 52 that is carrying the total weight. By substituting the mesh layer 54 for the return conductor, the illustrated wireline 90 may have a lower weight, a smaller diameter, and use less material than would be available with larger bundles of electrical conductors 92. The reduced size and weight may lead to a decreased bending radius of the wireline 90, making it more suitable for deployment into hard to reach, deviated wellbores, and making it easier to spool and unspool. In addition, the decreased weight and fewer materials may facilitate easier and cheaper assembly of the wireline 90 than would be available using other systems.

Figure 5:
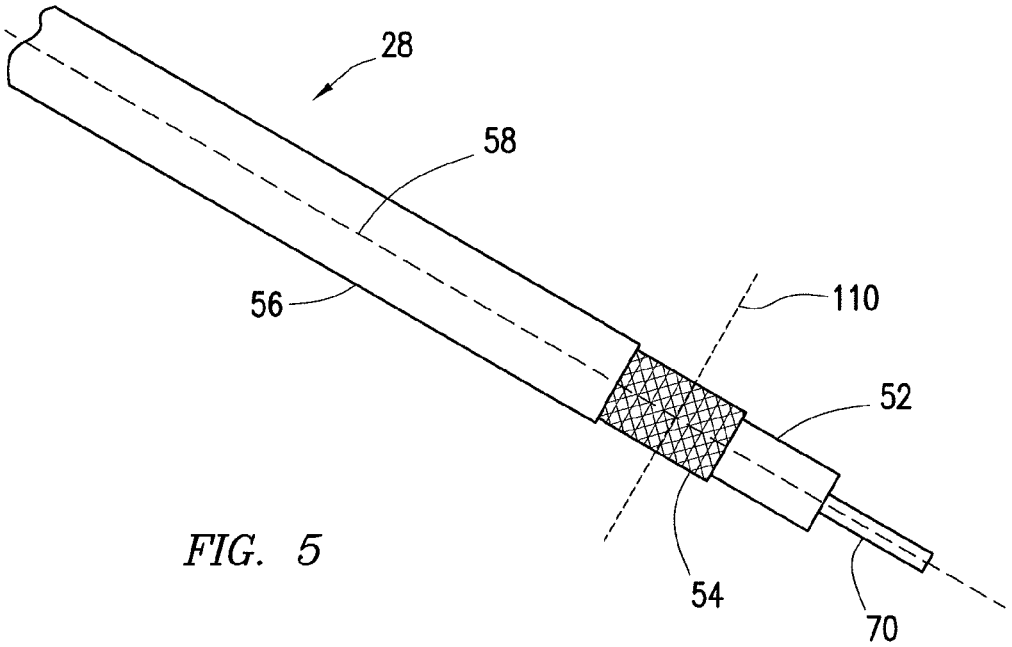
FIG. 5 is an exploded schematic view of the slickline/wireline of FIG. 1, in accordance with an embodiment of the present disclosure.

FIG. 5 is an exploded perspective view of an embodiment of the conveying member 28 having the mesh layer 54 described in detail above. The conveying member 28 may include one or more conductors 70 disposed in the core support structure 52, which is surrounded by the mesh layer 54 and subsequently the polymeric coating 56. As illustrated, the mesh layer 54 may include a helical wrap of some material (e.g., metal) around the core support structure 52. The helical wrap may include at least two windings that crisscross each other along the length of the conveying member 28. As noted above, it may be desirable for at least a portion of the mesh layer 54 to include fibers, ribbons, sheets, or wires wrapped in an orthogonal manner relative to the axis 58 of the conveying member 28. That is, at least a portion of the mesh layer 54 may be wrapped around the core support structure 52 along a plane 110 that is orthogonal to the axis 58. Even so, the mesh layer 54 may still crisscross at other portions, ensuring a tightly wound and continuous wrapping of the core support structure 52.

Figure 6:
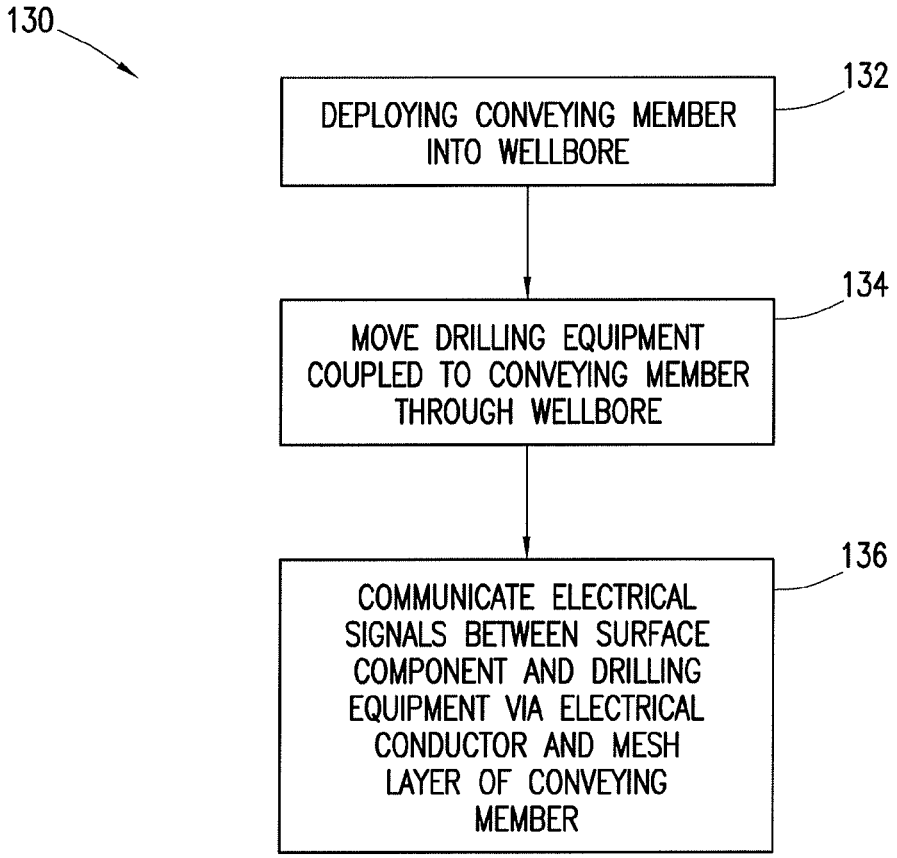
FIG. 6 is a process flow diagram of a method for operating the slickline/wireline of FIG. 1, in accordance with an embodiment of the present disclosure.

FIG. 6 is a process flow diagram illustrating a method 130 of operating the conveying member 28 disclosed above in reference to FIGS. 1-5. The method 130 may include deploying (block 132) the conveying member 28 into a wellbore and moving (block 134) well servicing equipment coupled to the conveying member 28 through the wellbore via the conveying member 28. In some embodiments, the method 130 may include communicating (block 136) electrical signals via an electrical conductor of the conveying member 28 and the mesh layer, the mesh layer being electrically conductive. As discussed in detail above with reference to FIGS. 2-5, the mesh layer 54 may oppose compressive forces on the conveying member 28 in a radial direction relative to the axis 58, while the fibers in the core support structure 52 may oppose tensile forces on the conveying member 28 in a direction of the axis 58. In addition, the mesh layer 54 may provide a higher coefficient of friction to the conveying member 28, thereby facilitating a gripping of the well servicing equipment onto the conveying member 28.

Although the present disclosure and its advantages have been described in detail, it should be understood that various changes, substitutions and alterations can be made herein without departing from the spirit and scope of the disclosure as defined by the following claims.

What is claimed is:

1. A cable system for conveying well servicing equipment into a wellbore, comprising:

a core support structure extending longitudinally along an axis of the cable system, wherein the core support structure comprises polymer reinforced with fibers, the fibers being oriented substantially parallel to the axis of the cable system;

a mesh layer disposed around the core support structure; and a polymeric coating disposed around and bonded to the mesh layer;

and wherein the mesh layer comprises a metallic material wrapped around the core support structure, wherein the mesh layer is bonded directly to at least one of the polymer of the core support structure and fibers of the core support structure, wherein the mesh layer comprises an alloy resistant to corrosion and hydrogen sulfide (H2S).

2. The cable system of claim 1, wherein the cable system does not comprise a central cable or conduct conductor disposed in the core support structure.

3. The cable system of claim 1, further comprising a core disposed at least partially within the core support structure, the core including a fiber optic strand to enable communication from the well servicing equipment to another point along the cable system.

4. The cable system of claim 1, further comprising a core disposed at least partially within the core support structure, the core including an electrically conductive cable to enable communication or power transmission from the well servicing equipment to another point along the cable system.

5. The cable system of claim 4, wherein the core further comprises a single electrically conductive cable and wherein the mesh layer comprises a return conductive path for electrical power or signals transmitted via the single electrically conductive cable.

6. The cable system of claim 1, wherein the mesh layer is at least partially wrapped around the core support structure in a plane orthogonal to the axis of the cable system.

7. The cable system of claim 1, further comprising the metallic material wrapped around the core support structure in sheets, ribbons, or wires.

8. The cable system of claim 1, further comprising the metallic material helically wrapped around the core support structure.

9. The cable system of claim 1, further comprising the metallic material braided around the core support structure.

10. The cable system of claim 1, wherein the core support structure comprises carbon fiber reinforced composite.

11. The cable system of claim 1, wherein the polymeric coating comprises polyether ether ketone.

12. A cable system for conveying well servicing equipment into a wellbore, comprising:

an interior cable extending along an axis of the cable system;

a core support member disposed around the interior cable, wherein the core support member comprises a composite material having fibers dispersed in a matrix, the fibers being substantially aligned with the axis of the cable system;

a metallic mesh layer disposed around the core support member; and a polymeric coating disposed around and bonded to the metallic mesh layer;

and wherein at least a portion of the metallic mesh layer is wrapped around the core support member within a plane that is substantially orthogonal to the axis of the cable system, wherein the mesh layer is bonded directly to at least one of the polymer of the core support structure and fibers of the core support structure, wherein the mesh layer comprises an alloy resistant to corrosion and hydrogen sulfide (H2S).

13. The cable system of claim 12, wherein the interior cable comprises a fiber optic cable of a slickline.

14. The cable system of claim 12, wherein the interior cable comprises an electrical conductor of a wireline.

15. The cable system of claim 14, wherein the metallic mesh layer comprises a return electrical path for the interior cable of the cable system.

16. A method, comprising:

deploying a cable system into a wellbore, wherein the cable system comprises a core support structure extending longitudinally along an axis, the core support structure comprising polymer reinforced with fibers oriented substantially parallel to the axis, a metallic mesh layer disposed around and bonded to the core support structure, and a polymeric coating disposed around and bonded to the metallic mesh layer, wherein the mesh layer is bonded directly to at least one of the polymer of the core support structure and fibers of the core support structure, wherein the mesh layer comprises an alloy resistant to corrosion and hydrogen sulfide (H2S); and moving well servicing equipment through the wellbore, the well servicing equipment being coupled to the cable system.

17. The method of claim 16, further comprising communicating electrical signals via an electrical conductor disposed within the core support structure and the metallic mesh layer, the metallic mesh layer being electrically conductive.

18. The method of claim 16, further comprising opposing tensile forces on the cable system in a direction of the axis via the fibers of the core support structure, and opposing compressive forces on the cable system in a radial direction relative to the axis via the metallic mesh layer.

19. The method of claim 16, further comprising facilitating a gripping of the well servicing equipment onto the cable system via the metallic mesh layer.

* * * * *